United States Patent [19]

Nagasaku et al.

[11] 4,403,929

[45] Sep. 13, 1983

[54] ROTARY COMPRESSOR

[75] Inventors: Eiichi Nagasaku, Chiryu; Masao Yasunaga; Kimihiro Kato, both of Kariya, all of Japan

[73] Assignee: Nippondenso Co., Ltd., Kariya, Japan

[21] Appl. No.: 229,852

[22] Filed: Jan. 30, 1981

[30] Foreign Application Priority Data

Feb. 4, 1980 [JP] Japan ..... 55-12882

[51] Int. Cl.[3] ..... F04C 29/02

[52] U.S. Cl. ..... 418/82; 418/93

[58] Field of Search ..... 418/93, 76, 82

[56] References Cited

U.S. PATENT DOCUMENTS

| | | | |
|---|---|---|---|
| 3,743,453 | 7/1973 | Abendschein et al. | 418/93 |
| 3,744,942 | 7/1973 | Mount | 418/99 |
| 3,865,520 | 2/1975 | Kramer et al. | 418/82 |
| 3,877,853 | 4/1975 | Harlin | 418/93 |
| 4,071,306 | 1/1978 | Calabretta | 418/82 |
| 4,104,010 | 8/1978 | Shibuya | 418/76 |

FOREIGN PATENT DOCUMENTS

| | | |
|---|---|---|
| 51-10411 | 1/1976 | Japan . |
| 51-133811 | 11/1976 | Japan . |

*Primary Examiner*—Ira S. Lazarus

*Attorney, Agent, or Firm*—Cushman, Darby & Cushman

[57] ABSTRACT

A rotary compressor including a housing having therein a cylindrical bore, and end plates closing opposite ends of the bore and supporting a rotary shaft supporting in turn a rotor formed with a plurality of circumferentially spaced vane grooves. A vane is slidably received in each vane groove and cooperates with the adjacent vane to define therebetween a working chamber. An oil groove is formed on a surface portion of one of the end plates which surface portion is located opposite to a path along which the bottoms of the vane grooves pass, at least in a position where the working chamber has its volume increased. A cover is attached to the one end plate to define therebetween a discharge chamber receiving therein fluid compressed by the vanes. A passage communicates an oil revervoir defined at the bottom of the discharge chamber and the axial end face of the shaft opposite to the one end plate with each other. The oil in the oil reservoir is introduced into the oil groove through the passage, along the outer periphery of the shaft, and through a gap between the rotor and the one end plate.

9 Claims, 6 Drawing Figures

ROTARY COMPRESSOR

BACKGROUND OF THE INVENTION (1) Field of the Invention

This invention relates to rotary compressors, and more particularly to a rotary compressor of the type suitable for use as a compressor for compressing a refrigerant for an air conditioning system of a motor vehicle, for example.

(2) Description of the Prior Art

In rotary compressors for compressing a refrigerant, it is necessary that back pressure be applied to the vanes to prevent chattering of the vanes during operation, as is disclosed in Japanese Patent Laid-Open Nos. 10411/76 and 133811/76. However, in case the back pressure applied to the vanes is too high, a loss of power would be great and the load applied to the prime mover would be increased. Moreover, a reduction in the service life of the compressors would result.

SUMMARY OF THE INVENTION

Accordingly, an object of this invention is to provide a rotary compressor in which chattering of the vanes can be avoided to ensure that the compressor can be operated without making noise.

Another object is to rpovide a rotary compressor of simple construction and low cost which eliminates the need to use a separate device for introducing oil into oil grooves.

Still another object is to provide a rotary compressor in which the oil intoroduced into the oil grooves is under a pressure which is suitably reduced, to minimize power loss and increase the durability of the vanes and housing.

According to the invention, there is provided a rotary compressor comprising a housing having therethrough a cylindrical bore; cover plates attached to the axial ends of the housing to close the open axial ends of the cylindrical bore, respectively; a shaft extending within the cylindrical bore in the housing and rotatably supported by the end plates, the shaft having an axis thereof extending in eccentric relation to the axis of the cylindrical bore in the housing; a rotor mounted on the shaft for rotation therewith and having a plurality of circumferentially spaced vane grooves, the rotor having axial end faces opposite to inner surfaces of the end plates, respectively; a vane slidably received in each of the vane grooves, each of the vanes cooperating with the adjacent vane, the wall surface of the cylindrical bore in the housing, the inner surfaces of the end plates and the outer periphery of the rotor to define a working chamber; one revolution of the rotor including a suction stroke section and a compression stroke section, the working chambers having their volumes increased during the suction stroke ssection and decreased during the compression stroke section; an oil groove formed in a portion, opposite to at least a portion of the suction stroke section, of the inner surface of at least one of the end plates, and located opposite to a path along which the bottoms of the vane grooves pass; a cover attached to the one end plate to define therebetween a discharge chamber having defined at the bottom thereof an oil reservoir; passage means for communicating the oil reservoir and the axial end face of the shaft opposite to the one end plate; and the oil in the oil reservoir being introduced into the oil groove through the passage means, along the outer periphery of the shaft, and through a gap between the rotor and the one end plate.

DESCRIPTION OF THE PREFERRED EMBODIMENTS

Figure 1:
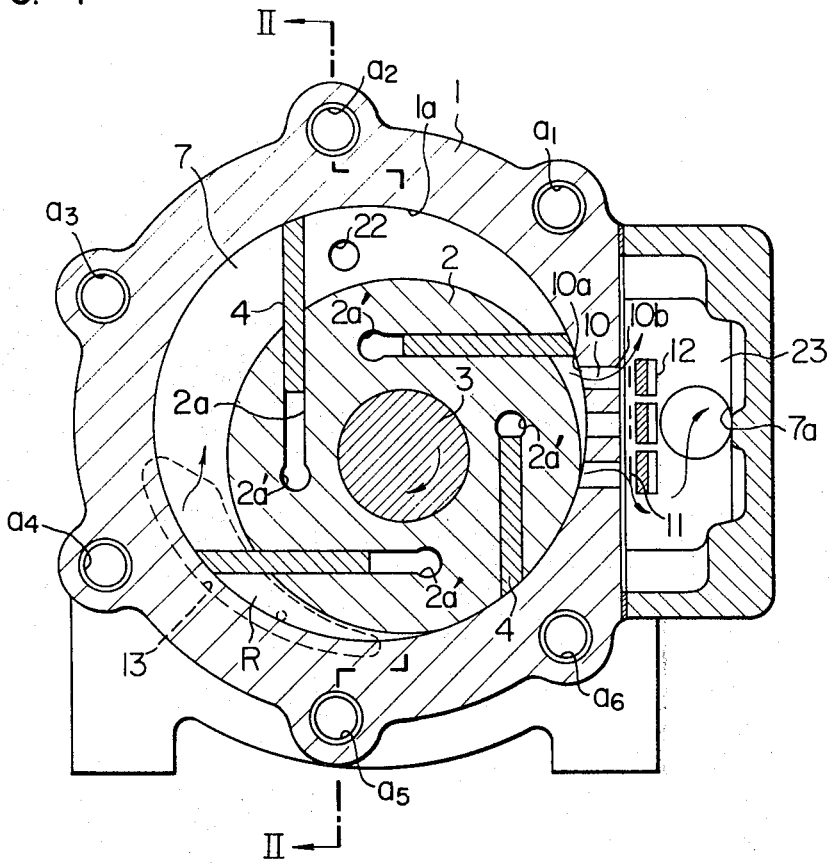
FIG. 1 is a sectional view of the rotary compressor comprising one embodiment of the invention, taken along the line I—I in FIG. 2.
Figure 3:
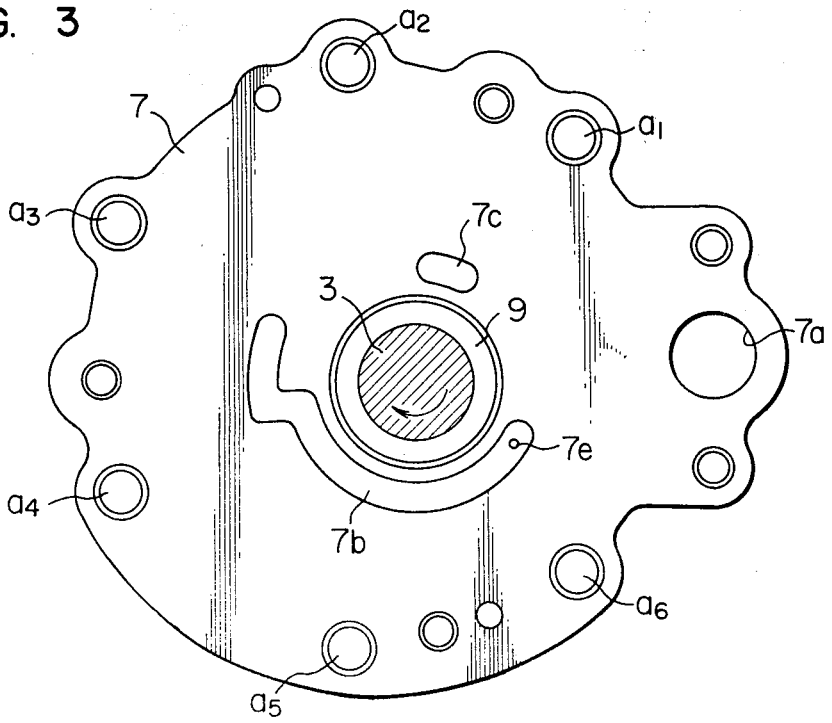
FIG. 3 is a sectional view taken along the line III—III in FIG. 2.
Figure 2:
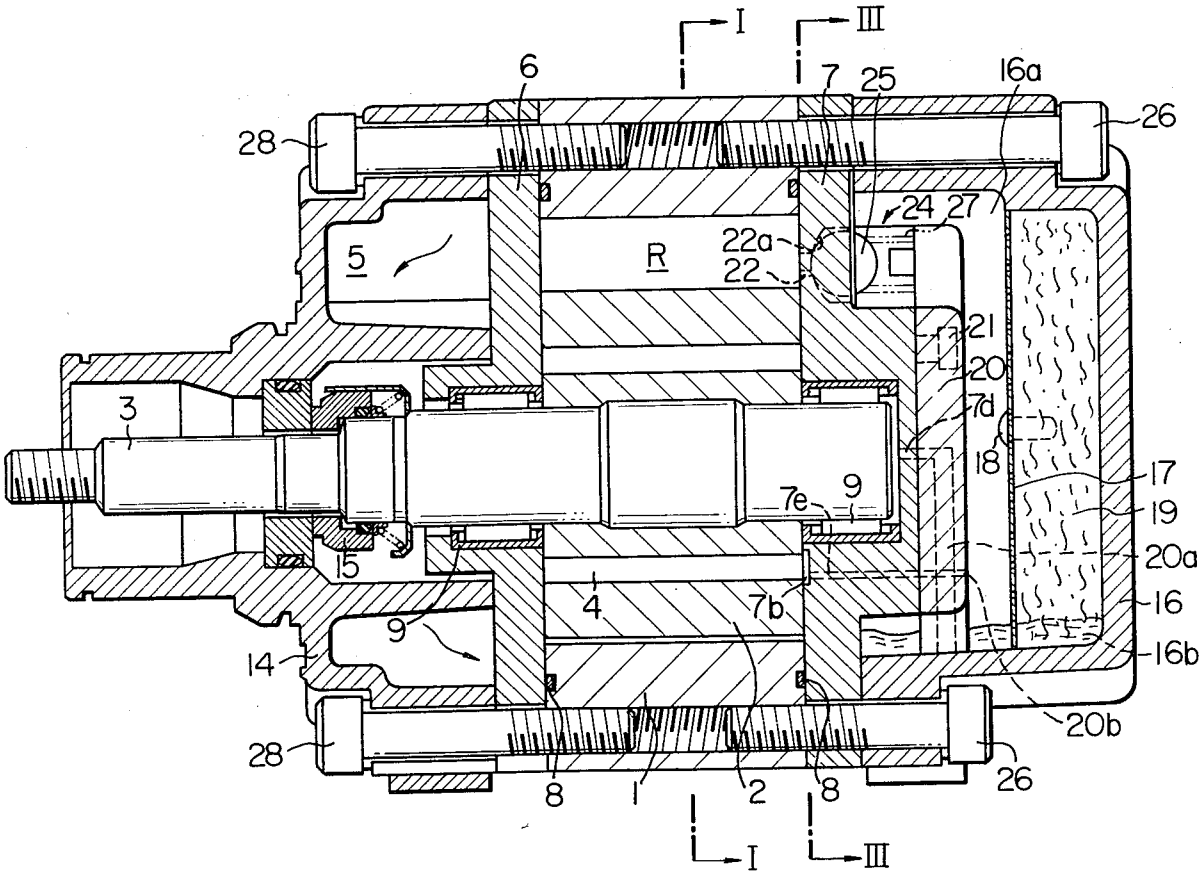
FIG. 2 is a sectional view taken along the line II—II in FIG. 1.

Referring to FIGS. 1–3, the rotary compressor according to the inventin comprises a housing 1 having therethrough a cylindrical bore 1*a*, and a cylindrical rotor 2 mounted eccentrically within the bore 1*a* of the housing 1. A rotary shaft 3 is force fitted in the rotor 2 and secured thereto for rotation therewith as a unit. The rotor 2 is formed with a plurality (four in number in this embodiment) of vane grooves 2*a* equidistantly spaced apart from one another circumferentially of the rotor 2. The vane grooves 2*a* each support a vane 4 for sliding movement.

End plates 6 and 7 are secured, through O-rings 8, to axial opposite ends of the housing 1, and the rotary shaft 3 is rotatably supported by the end plates 6 and 7 through bearings 9.

The end plates 6 and 7 cooperate with the adjacent two vanes 4, the wall surfaces of the cylindrical bore 1*a* and the outer circumferential surface of the rotor 2 to define a working chamber R. The housing 1 is formed with a discharge port 10 including a plurality of bores, the discharge port 10 having one end 10*a* successively communicating with the working chambers R and another end 10*b* communicating, through a discharge valve 11, with a first discharge chamber 23. The movement of the discharge valve 11 is regulated by a stopper 12.

First and second oil grooves 7*b* and 7*c* are formed on the end plate 7 disposed on the rear end (hereinafter referred to as rear end plate 7) of the housing 1 and located in positions in which they face the working chambers R and are juxtaposed against a path along which bottoms 2*a*′ of the vane grooves 2*a* pass. The oil groove 7*b* is disposed in a suction stroke section extending from a position in which the vane 4 is slidably withdrawn to the lowermost position in the vane groove 2*a* after passing by the discharge port 10 to a postion in which the vane 4 is slidably extended to the uppermost portion in the vane groove 2*a* as the working chamber R has its volume maximized. Stated differently, the first oil groove 7*b* extends along substantially the entire length of the suction stroke section in which the working chamber R has its volume increased. The second oil groove 7*c* is located between predetermined angular positions of an intermediate section of a compression stroke section in which the working chamber R has its volume reduced.

An annular front cover 14 is intimately secured to the end plate 6 on the front end of the housing 1 (hereinafter referred to as front end plate 6). The front cover 14 is formed with a not shown suction port for drawing a refrigerant from an evaporator, not shown. The refrigerant is introduced into a suction chamber 5 formed in the front cover 14, and then led into the working chambers R through a suction port 13 formed in the front end plate 6.

A seal assembly 15 is mounted between the front cover 14 and the rotary shaft 5 for providing a seal to the latter to avoid leakage of the refrigerant and lubricant along the rotary shaft 3 to outside.

A rear cover 16 is in the form of a cylinder with a closed bottom is attached to the rear end plate 7 to define therebetween a second discharge chamber 16*a*, and has a filter element 17 formed of a porous plate secured by a bolt 18 to the closed bottom portion thereof. An oil separator 19 formed of unwoven metal cloth and arranged in a complex three-dimensional structure is stuffed between the filter element 17 and the bottom of the rear cover 16.

A keep plate 20 is secured by bolts 21 to an end face of the rear end plate 7 facing the rear cover 16 and formed therein with an oil feeding passage 20*a* communicating an oil reservoir 16*b* formed in the bottom of the second discharge chamber 16*a* with an oil feeding port 7*d* formed in the rear end plate 7, so that the lubricant in the reservoir 16*b* can be drawn by differential pressure through the oil feeding passage 20*a* and the oil feeding port 7*d* to the end face of the rotary shaft 3. To avoid drawing of no more lubricant than is necessary, the oil feeding port 7*d* has a diameter of 1–3 mm to offer resistance to the flow of the lubricant or to restrict the flow of the lubricant therethrough. The lubricant supplied to the end face of the rotary shaft 3 flows from the circumferential surface thereof to between the end faces of the end plates 6 and 7 and the rotary 2, to feed the lubricant to the bearings 9 and the end faces of the rotor 2.

The rear end plate 7 and the keep plate 20 are formed with communicating ducts 7*e* and 20*b* respectively for communicating the vicinity of the trailing end of the first oil groove 7*b* with the second discharge chamber 16*a* in the rear cover 16.

The front cover 14, end plates 6 and 7, housing 1 and rear cover 16 are all formed of an aluminum alloy, and tightly secured together by bolts 26 and 28. The housing 1 is formed with bolt receiving openings designated by the numerals a1–a6 in FIG. 1.

The rear end plate 7 is formed with a communicating port 22 in a position in which the working chamber R begins to have its volume reduced and the working chamber R is not yet brought into communication with the discharge port 10 or, stated differently, a position in which a compression stroke is initiated, for communicating the working chamber R with the second discharge chamber 16*a* in the rear cover 16. The communicating port 22 has mounted therein a check valve assembly 24 for opening the communicating port 22 only when the internal pressure of the working chamber R has risen a predetermined amount (between 1 and 5 atmospheric pressures, for example, and preferably 1 atmospheric pressure) above the pressure in the second discharge chamber 16*a*, to allow the refrigerant in the working chamber R to escape to the second discharge chamber 16*a*.

As shown in FIG. 2, the check valve assembly 24 comprises a valve body 25 operative to abut against a tapering surface 22*a* of the communicating port 22 to block the port 22, and a spring 27 urging by its biasing force the valve body 25 to move in a direction in which the valve body 25 closes the port 22. The spring 27 is secured to the keep plate 20. The valve body 25 is in the form of a ball made of steel.

The operation of the rotary compressor of the aforesaid construction will now be described. As the rotary shaft 3 is rotated by the motive force produced by a drive source, such as an automatic vehicle engine, not shown, the rotor 2 and the vanes 4 are rotated as a unit and the working chambers 4 show changes in volume. When the working chamber R is disposed in a position in which its volume increases, a refrigerant introduced into the suction chamber 5 in the front cover 14 from the refrigeration cycle is drawn by suction into the working chamber R through the suction port 13. The refrigerant in a gaseous state drawn into the working chamber R is cut off the suction port 13 as the working chamber R rotates and then compressed as the volume of the working chamber R is reduced until the volume is minimized, when the working chamber R is brought into communication with the discharge port 10. Thus the compressed refrigerant is discharged from the working chamber R through the discharge valve 11 into the first discharge chamber 23.

From the first discharge chamber 23, the gaseous refrigerant flows through an outlet duct 7*a* formed in the rear end plate 7 into the second discharge chamber 16*a* in the rear cover 16, from which the gaseous refrigerant is discharged, after having the lubricant separated therefrom by the oil separator 19, into the condenser of the refrigeration cycle.

During operation, the vanes 4 are withdrawn from the vane grooves 2*a* largely by centrifugal forces into sliding contact with the inner wall surface of the housing 1 defining the bore 1*a*. In the rotary compressor of this constructional form, the oil grooves 7*b* and 7*c* communicating with the bottom portions 2*a*′ of the vane grooves 2*a* are formed in the rear end plate 7. By this arrangement, the vane 4 being withdrawn from the vane groove 2*a* in the suction stroke section is under the influence of the pressure in the first oil groove 7*b*, so that the vane 4 can be pressed with increased force against the inner wall surface of the housing.

More specifically, in the rotary compressor of this constructional form, the oil reservoir 16*b* is maintained in communication with the end face of the rotary shaft 3 through the oil feeding port 7*d* and the oil feeding passage 20*a*, and the pressure (about 16–18 atmospheric pressures) of the gaseous refrigerant compressed in the working chamber R is applied to the second discharge chamber 16*a*, so that the lubricant in the oil reservoir 16*b* is urged by the pressure of the gaseous refrigerant to flow upwardly to the end face of the rotary shaft 3, from which the lubricant flows along the outer circumferential surface of the rotary shaft 3 and through the bearing 9 into a gap (which is about 0.02 mm in dimension) between the rotor 2 and the rear end plate 7. The lubricant flowing into the gap then flows on the end face of the rotor 2 in a direction in which the working chamber R has its volume increased, so that the pressure of the lubricant is applied to the first oil groove 7*b* to aid the vane 4 in being withdrawn from the vane groove 2*a* in the suction stroke section. The vane 4 is withdrawn from the vane groove 2*a* by centrifugal forces combined with the pressure of the lubricant in the first oil groove 7*b*, so that the forward end of the vane 4 is positively brought into sliding contact with the inner wall surface of the housing 1 defining the bore 1*a* and chattering of the vanes 4 in the vane grooves 2*a* can be avoided during operation.

In the rotary compressor of this constructional form, the pressure of the lubricant in the oil reservoir 16*b* is not applied to the first oil groove 7*b* as it is. Instead, the pressure of the lubricant is greatly reduced when applied to the first oil groove 7*b*, due to the throttling of the lubricant flow at the oil feeding port 7*d* and the resistance offered to the flow of the lubricant through the clearance between the end face of the rotor 2 and the rear end plate 7. Thus the pressure in the first oil groove 7*b* is not much higher than the pressure (about 2–3 atmospheric pressures) of the refrigerant in the working chamber R in the suction stroke section.

By virtue of the aforesaid features, the vanes 4 of the compressor according to the invention are forced out of the vane grooves 2*a* with enough force to positively bring the vanes 4 into sliding contact with the inner wall surface of the housing 1 but the force is not too high and causes to disadvantage. Thus there are no risks of the surface pressure between the forward ends of the vanes 4 and the inner wall surface of the housing 1 becoming higher than is necessary, the loss of power becoming too great and the durability of the compressor being reduced.

In the compression stroke section in which the vane 4 is forced into the vane groove 2*a*, the vane groove 2*a* communicates with the second oil groove 7*c* which is filled with the lubricant that has flowed through the clearance between the end face of the rotor 2 and the rear end plate 7, to feed the lubricant to the bottom portion 2*a*' of the vane groove 2*a*. Thus, after passing by the second oil groove 7*c*, the vane 4 is forced into the vane groove 2*a* while compressing the lubricant fed into the vane groove 2*a* from the second oil groove 7*c*, so that a sufficiently high surface pressure can be maintained between the forward end of the vane 4 and the inner wall surface of the housing 1 by the reaction of the lubricant compressed by the vane 4 in the vane groove 2*a*.

The provision of the first and second oil grooves 7*b* and 7*c* according to the invention enables an optimum surface pressure to be maintained between the forward end of the vane 4 and the inner wall surface of the housing 1 both in the suction stroke section and the compression stroke section. As a result, both chattering and leaping of the vanes 4 in the vane grooves 2*a* can be avoided, thereby ensuring that the rotary compressor operates quietly without making any noise.

The rotary compressor of the aforesaid constructional form might be faced with the difficulty with which the compressor performs its function due to the first oil groove 7*b* being sealed at startup. If this phenomenon occurs, the vanes 4 could not be withdrawn readily and the performance of the compressor would be impaired. To avoid this trouble, the first oil groove 7*b* formed in the rear end plate 7 is maintained in communication with the second discharge chamber 16*a* in the rear cover 16 through the communicating duct 7*e* and the communicating duct 20*b* formed in the keep plate 20, to avoid sealing of the first oil groove 7*b* at startup. This eliminates the risk that the pressure at the back of the vanes 4 is reduced, and enables the vanes 4 to be smoothly withdrawn from the vane grooves 2*a* by centrifugal forces, to thereby permit the compressor to initiate compression of the refrigerant without any trouble.

The invention has been shown and described by referring to a preferred embodiment. However, the invention is not limited to the specific form of the embodiment and many changes and modifications may be made therein.

Figure 4:
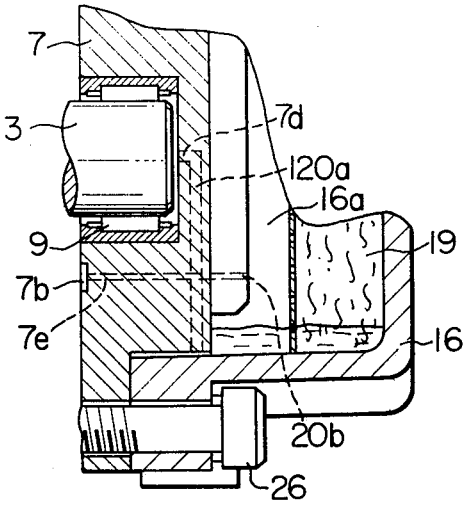
FIG. 4 is a sectional view of the essential portions of a modification of the embodiment shown in FIG. 1.

For example, the oil feeding passage 20*a* is shown in the embodiment of FIGS. 1–3 as being formed in the keep plate 20. However, the same results can be achieved by forming an oil feeding passage 120*a* in the rear end plate 7 in place of the oil feeding passage 20*a* formed in the keep plate 20, as shwon in FIG. 4. In this case, the oil feeding port 7*d* juxtaposed against the end face of the rotary shaft 3 has a diameter of 1–3 mm to offer resistance to the flow of the lubricant therethrough, as is the case with the embodiment shown in FIGS. 1–3.

Figure 5:
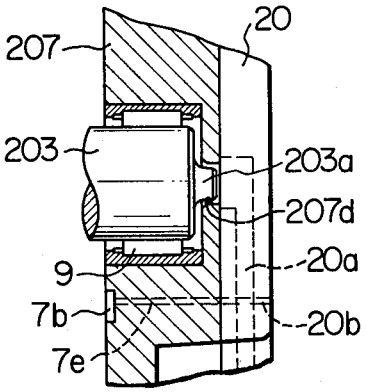
FIG. 5 is a sectional view of the essential portions of another modificatin of the embodiment shown in FIG. 1.

To offer resistance to the flow of the lubricant, a projection 203*a* may be formed integrally with the rotary shaft 203 at its end face and loosely inserted in the oil feeding port 207*d* formed in the rear end plate 207, as shown in FIG. 5, so as to throttle the flow of the lubricant by a clearance between the inner surface of the oil feeding port 207*d* and the outer circumferential surface of the projection 203*a*. In this case, the need to reduce the diameter of the oil feeding port 207*d* can be eliminated, thereby facilitating the application of pressure.

Figure 6:
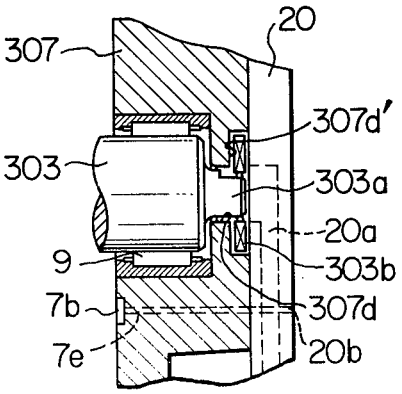
FIG. 6 is a sectional view of the essential portions of still another modification of the embodiment shown in FIG. 1.

Alternatively, as shown in FIG. 6, a rotary disk 303*b* may be attached to the projection 303*a* of the rotary shaft 303, and a recess 307*d*' for receiving the rotary disk 303*b* may be formed in the oil feeding port 307*d* formed in the rear end plate 307, to throttle the flow of the lubricant by a clearance between the bottom surface of the recess 307*d*' and the rotary disk 303*b*. In this case, the rotation of the rotary disk 303*b* with the rotary shaft 303 as a unit permits any foreign matter incorporated in the lubricant flowing from the oil feeding passage 20*a* to be flipped by the rotary disk 303*b*, with a result that the amount of the foreign matter flowing through the clearance between the recess 307*d*' and the rotary disk 303*b* to the end face of the rotary shaft 303 can be greatly reduced. In the compressor of this modified constructional form, obturation of the oil feeding port 307*d* by foreign matter can be avoided and the compressor can continue its satisfactory performance over a prolonged period of time.

From the foregoing description, it will be appreciated that the novel features of the invention described hereinabove enable satisfactory operation of the compressor to be obtained. The provision of the first oil groove in the rear end plate in a position corresponding to the position of the vane groove for the vane in the suction stroke section enables the vane in the suction stroke section to be withdrawn from the associated vane groove by the pressure of the lubricant in the first oil groove. By this feature, the vanes can be kept in firm sliding contact with the inner wall surface of the housing at all times and chattering can be avoided, to enable the compressor to operate quietly at all times.

The lubricant introduced into the first oil groove in the compressor according to the invention is fed thereinto by differential pressure, so that an additional device for feeding oil, such as an oil pump, can be eliminated. This is conducive to simplification of the construction of the compressor and a reduction in cost.

The lubricant introduced into the first oil groove is subjected to a resistance offered to its flow as it flows through the oil feeding port, etc., before being fed into the oil groove. Because of this arrangement, the pressure of the lubricant in the first oil groove is suitably reduced and prevented from becoming higher than is necessary for forcing the vanes against the inner wall surface of the housing. Thus a loss of power can be minimized, sealing of the working chambers can be effected satisfactorily and the service life of the compressor can be prolonged.

What we claim is:

1. A rotary compressor comprising:

a housing having therethrough a cylindrical bore;

cover plates attached to the axial ends of said housing to close the open axial ends of said cylindrical bore, respectively;

a shaft extending within said cylindrical bore in said housing and rotatably supported by said end plates, said shaft having an axis thereof extending in eccentric relation to the axis of the cylindrical bore in said housing;

a rotor mounted on said shaft for rotation therewith and having a plurality of circumferentially spaced vane grooves, said rotor having axial end faces opposed to inner surfaces of said end plates, respectively;

a vane slidably received in each of said vane grooves, each of said vanes cooperating with the adjacent vane, the wall surface of said cylindrical bore in said housing, the inner surfaces of said end plates and the outer periphery of said rotor to define a working chamber;

one revolution of said rotor including a suction stroke section and a compression stroke section, said working chambers having their volumes increased during said suction stroke section and decreased during said compression stroke section;

an arcuate oil groove formed in the inner surface of at least one of said end plates, said arcuate oil groove extending in the area of the suction stroke section and being substantially coincident with an arcuate path described by the bottoms of said vane grooves;

a cover attached to said one end plate to define therebetween a discharge chamber receiving therein fluid compressed in said working chamber, said discharge chamber having defined at the bottom thereof an oil reservoir;

passage means having therein restrictive means and supplying oil from said oil reservoir to said oil groove through said restriction means so that the pressure of the oil in said oil groove is lower than that in said oil reservoir; and the oil being fed to said vane groove mainly when said vane is in said suction stroke section.

2. A rotary compressor as defined in claim 1, wherein said passage means includes therein a restriction for restricting flow of the oil passing through said passage means.

3. A rotary compressor as defined in claim 2, wherein said restriction comprises a disc connected to said shaft for rotation therewith, and an annular recess formed in said one end plate, said disc being received in said annular recess with a clearance left therebetween.

4. A rotary compressor as defined in claim 1, further comprising second passage means for communicating said oil groove and said discharge chamber with each other to prevent said oil groove to become sealed condition upon the start of operation of the compressor.

5. A rotary compressor as defined in claim 1, further comprising a second oil groove formed in a portion, opposite to a portion of said compression stroke section, of the inner surface of at least one of said end plates, said second oil groove being located opposite to said path of the bottoms of said vane grooves.

6. A rotary compressor as defined in claims 1, 2, 3, 4 or 5, wherein the compressor is one for use in refrigerators, in which refrigerant having admixed thereto lubricating oil is compressed and discharged into said discharge chamber.

7. A rotary compressor as defined in claim 1, wherein said passage means comprises:

a space formed between the end face of said shaft and an inner surface of said one end plate;

oil feeding passage means connecting said oil reservoir with said space; and an annular space defined between the outer peripheral surface of said shaft and a cylindrical inner surface of said one end plate, and a gap between said rotor and said one end plate.

8. A rotary compressor as defined in claim 7, wherein said restriction means is formed by said gap between said rotor and said one end plate.

9. A rotary compressor as defined in claim 7, wherein said restriction means comprises a projection formed at an end face of said shaft, said projection being loosely inserted in said oil feeding passage means so as to throttle the flow of oil passing through said oil feeding passage means.

* * * * *